US008272915B2

(12) United States Patent
Thai

(10) Patent No.: US 8,272,915 B2
(45) Date of Patent: Sep. 25, 2012

(54) BUBBLE GENERATING ASSEMBLY THAT PRODUCES VERTICAL BUBBLES

(75) Inventor: Douglas Thai, Walnut, CA (US)

(73) Assignee: Arko Development Ltd., Hong Kong (HK)

( * ) Notice: Subject to any disclaimer, the term of this patent is extended or adjusted under 35 U.S.C. 154(b) by 356 days.

(21) Appl. No.: 12/070,259

(22) Filed: Feb. 15, 2008

(65) Prior Publication Data

US 2009/0209163 A1 Aug. 20, 2009

(51) Int. Cl.
*A63H 33/28* (2006.01)

(52) U.S. Cl. ..... 446/15; 446/16

(58) Field of Classification Search ..... 446/15–21; D21/401

See application file for complete search history.

(56) References Cited

U.S. PATENT DOCUMENTS

| | | | | |
|---|---|---|---|---|
| 185,279 | A | | 12/1876 | Baker et al. |
| 430,095 | A | | 6/1890 | Thain |
| 616,239 | A | | 12/1898 | King |
| 660,485 | A | | 10/1900 | Bradshaw |
| 2,041,423 | A | | 5/1936 | Mausolf |
| 2,213,391 | A | | 9/1940 | Gamble |
| 2,225,702 | A | | 12/1940 | Lyon, Jr. |
| 2,391,797 | A | * | 12/1945 | Raspet ..... 446/21 |
| 2,393,039 | A | | 1/1946 | Gilchrist, Jr. |
| 2,396,433 | A | | 3/1946 | Pimblett |
| 2,398,513 | A | | 4/1946 | Bradley |
| 2,412,732 | A | | 12/1946 | Holman |
| 2,527,935 | A | | 10/1950 | Joel, II |
| 2,547,825 | A | | 4/1951 | King |
| 2,560,582 | A | | 7/1951 | Limber |
| 2,587,537 | A | | 2/1952 | Scott |
| 2,606,396 | A | | 8/1952 | Hill |
| 2,632,281 | A | | 3/1953 | Schmidt, Jr. |
| 2,659,177 | A | | 11/1953 | Kopf |
| 2,700,845 | A | | 2/1955 | Arliss |
| 2,711,051 | A | | 6/1955 | Pick |
| 2,736,988 | A | | 3/1956 | Fisher |
| D185,805 | S | | 8/1959 | Clark |
| 2,974,438 | A | | 3/1961 | Hopkins |
| 2,987,847 | A | | 6/1961 | Jones |
| 3,008,263 | A | | 11/1961 | Ellman |
| 3,071,888 | A | | 1/1963 | Knott |
| 3,100,947 | A | | 8/1963 | Hellman |

(Continued)

FOREIGN PATENT DOCUMENTS

CN 2930817 Y * 8/2007

OTHER PUBLICATIONS

Zhang, Aug. 2007, Machine Translation, pp. 1-6.*

(Continued)

*Primary Examiner* — Gene Kim
*Assistant Examiner* — Matthew B Stanczak
(74) *Attorney, Agent, or Firm* — Raymond Sun

(57) ABSTRACT

A bubble generating assembly has a housing having a motor, an air generator coupled to the motor, and a bubble generator associated therewith. The assembly also includes a source of bubble solution, and a pump system provided inside the housing that draws bubble solution from the source to the bubble generator. The bubble generator includes a plurality of openings, with bubble solution delivered to the bubble generator flowing through the openings. The air from the air generator is delivered upwardly through the openings.

16 Claims, 5 Drawing Sheets

U.S. PATENT DOCUMENTS

| | | | |
|---|---|---|---|
| 3,109,255 | A | 11/1963 | Hein |
| 3,183,621 | A | 5/1965 | Allen, Jr. |
| 3,228,136 | A | 1/1966 | Rouse |
| 3,323,250 | A | 6/1967 | Gibbons |
| 3,420,412 | A | 1/1969 | Greene |
| 3,579,898 | A | 5/1971 | Hein |
| 3,601,313 | A | 8/1971 | Berg |
| 3,604,144 | A | 9/1971 | Span |
| 3,731,412 | A | 5/1973 | Winslow |
| 3,736,694 | A | 6/1973 | Lebensfeld |
| 3,845,583 | A | 11/1974 | Ziff |
| 3,913,260 | A | 10/1975 | Corbett |
| 3,925,923 | A | 12/1975 | La Fata et al. |
| 3,952,447 | A | 4/1976 | Hackell |
| 4,246,717 | A | 1/1981 | Wachtel |
| D263,062 | S | 2/1982 | Rasmussen |
| 4,423,565 | A | 1/1984 | Bart |
| 4,438,955 | A | 3/1984 | Ryan |
| 4,447,982 | A | 5/1984 | Gushea |
| 4,467,552 | A | 8/1984 | Jernigan |
| 4,481,731 | A | 11/1984 | La Fata et al. |
| 4,603,021 | A | 7/1986 | Urso |
| 4,700,965 | A | 10/1987 | Kinberg |
| 4,775,348 | A | 10/1988 | Collins |
| 4,804,346 | A | 2/1989 | Sheng |
| RE32,973 | E | 7/1989 | Panzarella |
| D304,466 | S | 11/1989 | Glickman |
| 4,957,464 | A | 9/1990 | Perez |
| 4,988,319 | A | 1/1991 | Shen |
| 5,035,665 | A | 7/1991 | Sheng |
| 5,230,648 | A | 7/1993 | Kelly et al. |
| 5,234,129 | A | 8/1993 | Lau |
| 5,395,274 | A | 3/1995 | Myers |
| 5,462,469 | A | 10/1995 | Lei |
| 5,498,191 | A | 3/1996 | DeMars |
| 5,520,564 | A | 5/1996 | DeMars |
| 5,542,869 | A | 8/1996 | Petty |
| 5,613,890 | A | 3/1997 | DeMars |
| 5,695,379 | A | 12/1997 | Ho |
| 5,832,969 | A | 11/1998 | Schramm |
| 5,842,899 | A | 12/1998 | Cernansky et al. |
| 5,850,945 | A | 12/1998 | Frankel |
| 5,879,218 | A | 3/1999 | Tao |
| 6,062,935 | A | 5/2000 | Gross |
| 6,102,764 | A | 8/2000 | Thai |
| 6,139,391 | A | 10/2000 | Thai |
| 6,149,486 | A | 11/2000 | Thai |
| 6,200,184 | B1 | 3/2001 | Rich et al. |
| 6,315,627 | B1 | 11/2001 | Thai |
| 6,331,130 | B1 | 12/2001 | Thai |
| 6,416,377 | B1 | 7/2002 | Bart |
| 6,544,091 | B1 | 4/2003 | Thai |
| 6,547,622 | B2 | 4/2003 | Thai |
| 6,620,016 | B1 | 9/2003 | Thai |
| 6,659,830 | B2 | 12/2003 | Thai |
| 6,786,251 | B2 * | 9/2004 | Nadel et al. ..... 141/98 |
| 6,893,314 | B2 | 5/2005 | Thai |
| 6,988,926 | B2 | 1/2006 | Thai |
| 2002/0061697 | A1 | 5/2002 | Hornsby et al. |

OTHER PUBLICATIONS

Little Tikes "Bubble Bellies", 2005 The little Tikes Company distributed by Imperial Toy Corp., Los Angeles, CA 90021.

* cited by examiner 105
115
116
100
101
94
162
126
128
32
112
114
40
38
102
106
108
104
110
92
160
164
122
123
121
124

BUBBLE GENERATING ASSEMBLY THAT PRODUCES VERTICAL BUBBLES

BACKGROUND OF THE INVENTION

1. Field of the Invention

The present invention relates to bubble toys, and in particular, to a bubble generating assembly which generates a stream of bubbles vertically upwardly without the need to dip any component of the assembly into a container or a dish of bubble solution.

2. Description of the Prior Art

Bubble producing toys are very popular among children who enjoy producing bubbles of different shapes and sizes. Many bubble producing toys have previously been provided. Recently, many bubble generating assemblies have been provided where a film of bubble solution is formed across a bubble ring without the need to dip the bubble ring into a dish of bubble solution. A stream of air is directed towards the film of bubble solution to generate a stream of bubbles. Examples of such bubble generating assemblies are shown in U.S. Pat. Nos. 7,223,149 (Thai), 6,682,570 (Thai), 6,755,710 (Thai), 7,144,291 (Thai), 7,182,665 (Thai) and 7,172,484 (Thai), among others. Most of these assemblies include a pump system which delivers bubble solution from a bubble source (e.g., a bottle) to the bubble ring, a linkage that moves a component (either a stationary bar or the bubble ring itself to form a film of bubble across the bubble ring, and an actuator that turns on a fan to direct the stream of air at the film of bubble solution.

While these bubble generating assemblies have been effective in producing streams of large and small bubbles, and in bringing considerable entertainment and fun to children, there still remains a need a bubble generating assembly which provides different variety of bubble play, and which generates a stream of bubbles without the need to dip any component of the assembly into a container or a dish of bubble solution to form a film of bubble solution.

SUMMARY OF THE DISCLOSURE

The objectives of the present invention are accomplished by providing a bubble generating assembly having a housing having a motor, an air generator coupled to the motor, and a bubble generator associated therewith. The assembly also includes a source of bubble solution, and a pump system provided inside the housing that draws bubble solution from the source to the bubble generator. The bubble generator includes a plurality of openings, with bubble solution delivered to the bubble generator flowing through the openings. The air from the air generator is delivered upwardly through the openings.

BRIEF DESCRIPTION OF THE DRAWINGS

FIGS. 6A and 6B illustrate the operation of the pump system of FIG. 5.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
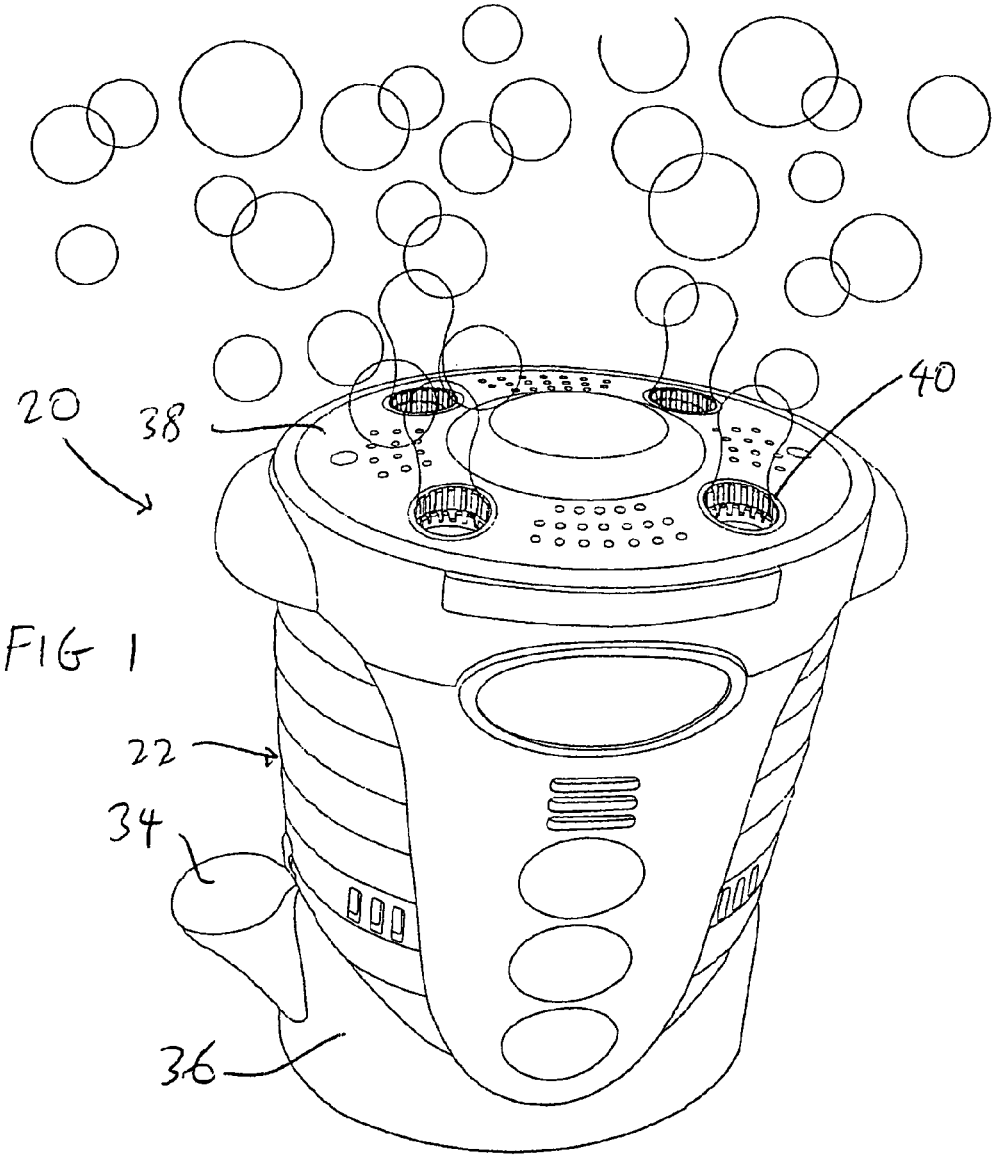
FIG. 1 is a front perspective view of a bubble generating assembly according to one embodiment of the present invention shown producing a plurality of bubbles.
Figure 8:
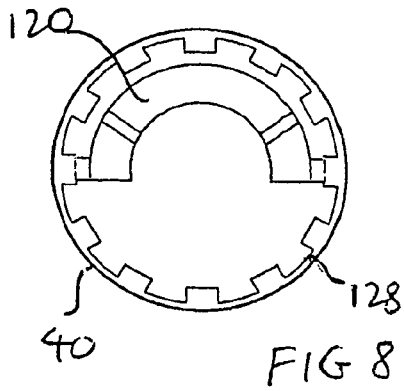
FIG. 8 is a top plan view of a bubble generating opening of the assembly of FIG. 1.

FIGS. 1-8 illustrate one embodiment of a bubble generating assembly 20 according to the present invention. The assembly 20 has a housing 22. The housing 22 can assume any shape, including a generally circular shape as shown in FIG. 1, and can be provided in the form of two symmetrical outer shells 22*a*, 22*b* (see also FIG. 2) that are connected together by, for example, screws or welding or glue. These outer shells together define a hollow interior for housing the internal components of the assembly 20, as described below. A switch 24 and a battery compartment 26 are provided on the shell 22*b*.

A bubble generator housing 30 can be housed inside the housing 22, and a solution container 28 can be partially housed inside the housing 22, with a portion of the base of the solution container 22 extending below and outside the shells 22*a*, 22*b* to act as the base 36 for the assembly 20. A tubing 32 extends from the interior of the solution container 28, through an opening in a top wall of the container 28, and into the bubble generator housing 30. The solution container 28 is adapted to hold bubble solution, and has a spout 34 through which bubble solution can be added by the user into the solution container 28. The bubble generator housing 30 has a top wall 38 that is exposed at the top of the shells 22*a*, 22*b*. As shown and described in greater detail below, a plurality of bubble openings 40 are provided in the top wall 38 through which bubbles can be emitted from the assembly 20.

Figure 2:
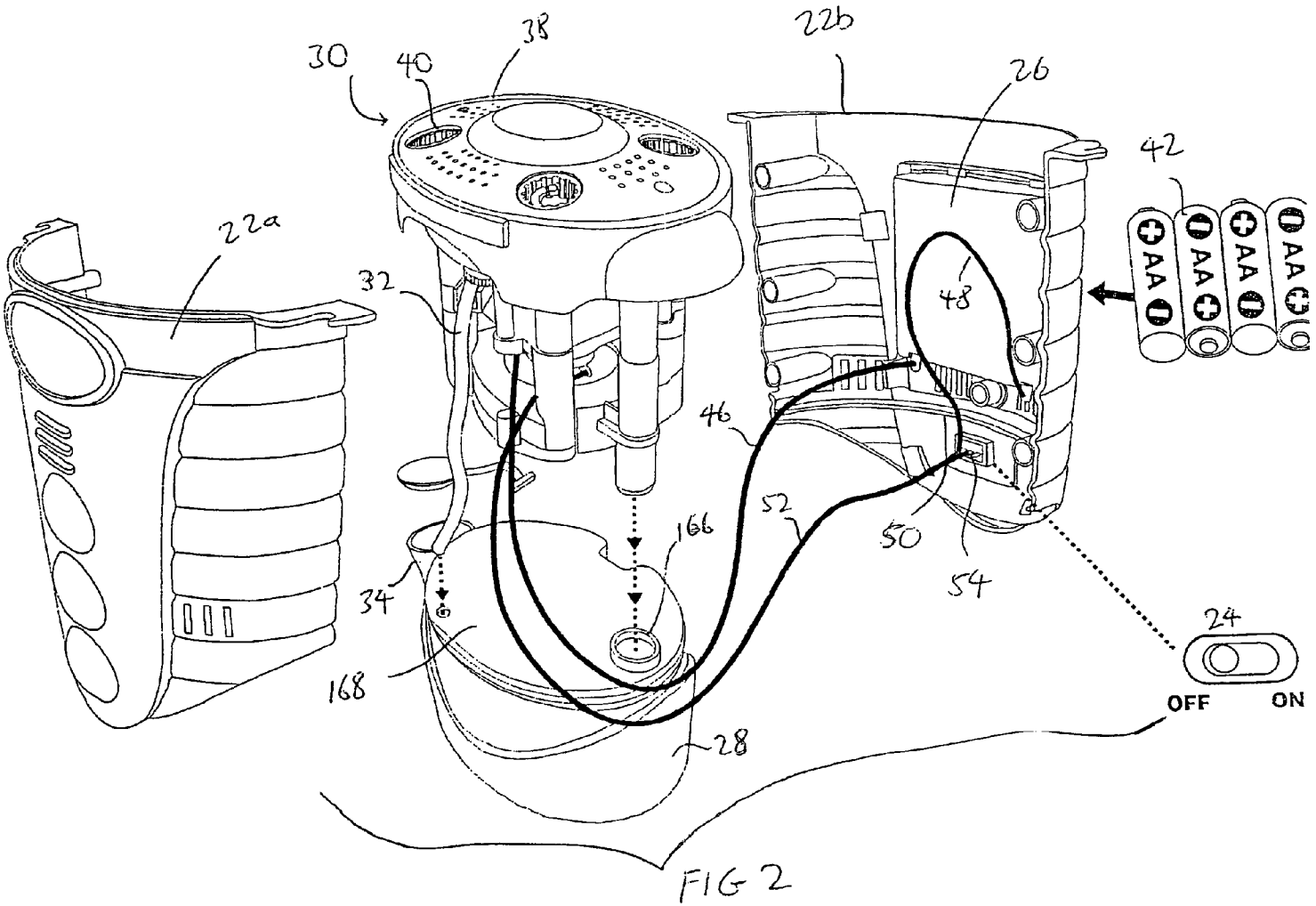
FIG. 2 is an exploded perspective view of the assembly of FIG. 1.
Figures 3, 4, 9:
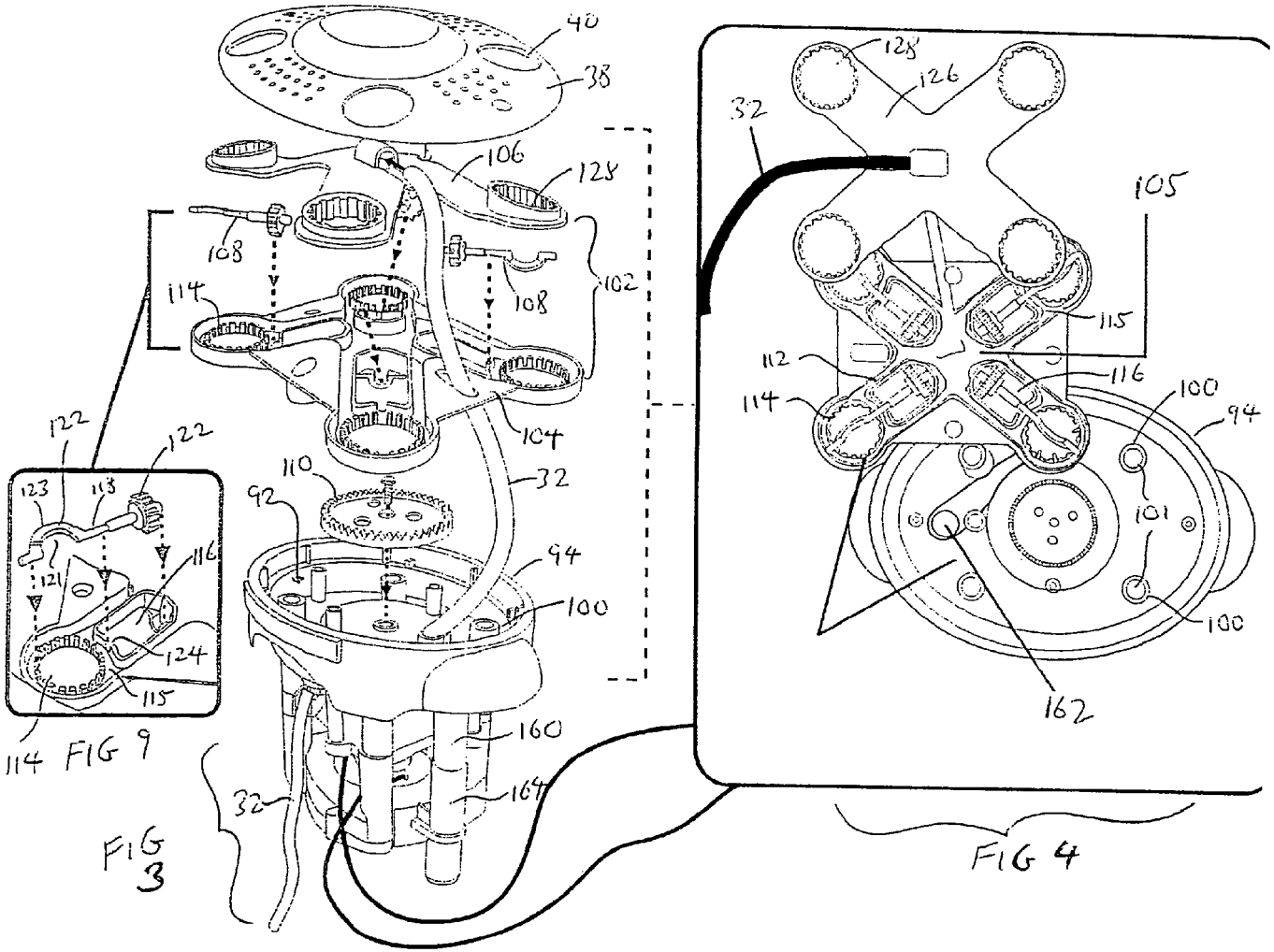
FIG. 3 is an exploded perspective view of some of the internal components of the assembly of FIG. 1.
FIG. 4 is a top exploded perspective view of the internal components of FIG. 3.
FIG. 9 is an enlarged view of a rotating applicator and its corresponding wand from the bubble generator.
Figure 7:
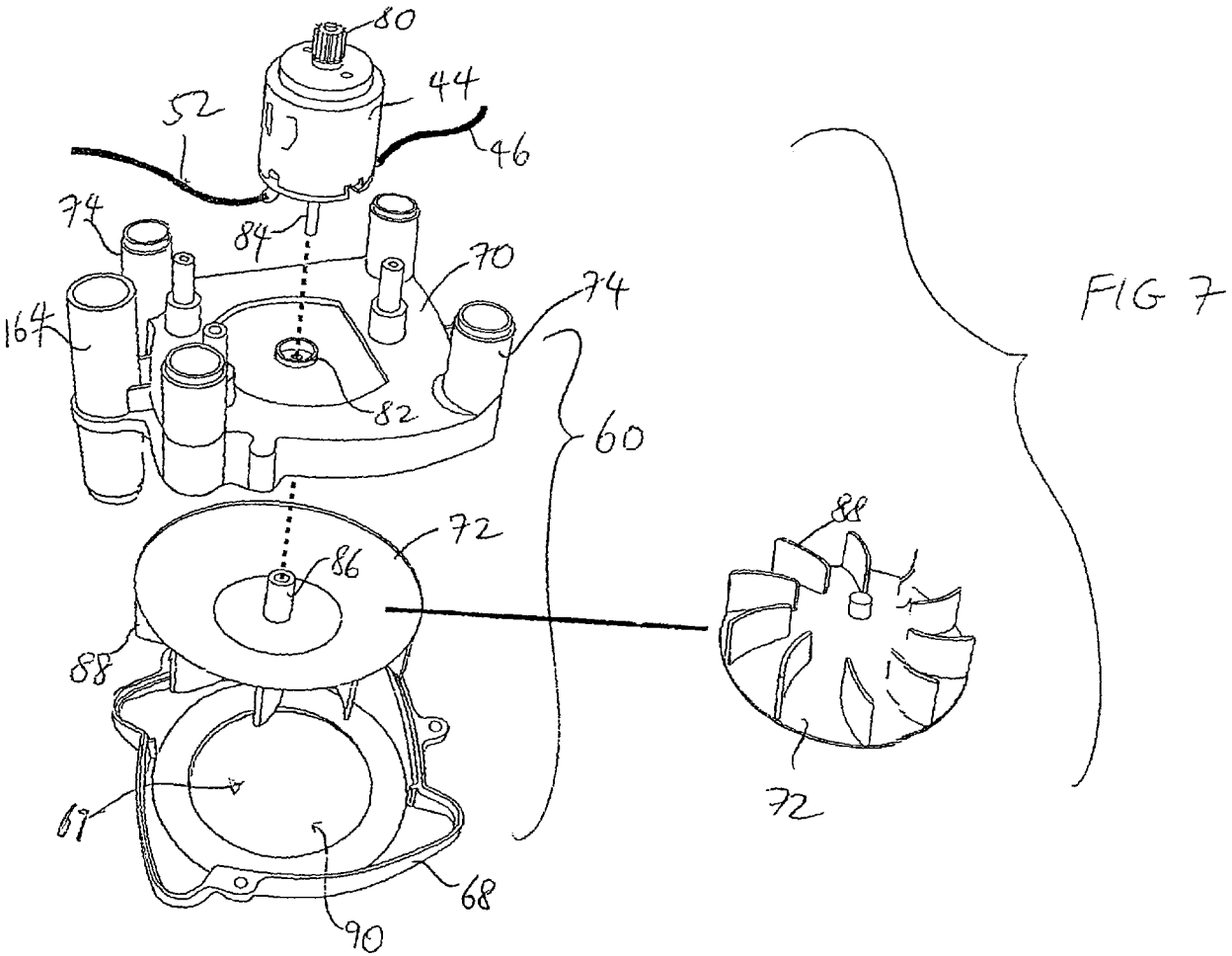
FIG. 7 is an exploded perspective view of the fan system of the assembly of FIG. 3

Referring to FIGS. 2, 3 and 7, the battery compartment 26 retains at least one conventional battery 42, which constitutes the power source. The power source can also be embodied in the form of an electrical plug that can be connected to an electrical outlet in the wall of a house. A motor 44 is electrically coupled to the power source via a first wire 46. A second wire 48 couples the power source to a contact 50 in the switch 24. A third wire 52 couples another contact 54 at the switch 24 to the motor 44. The contacts 50 and 54 are adapted to releasably engage to form a closed electrical circuit when the user turns on the switch 24.

Referring now to FIGS. 2-7, the motor 44 is received in a motor mount that is part of a fan housing 60, and positioned between a gear and pump housing 62 and the fan housing 60. The gear and pump housing 62 includes a top plate 64 and a bottom plate 66 that together defines an interior space for receiving the gear system and the pump system described below. The fan housing 60 includes a fan support base 68 and an upper housing 70 that defines an interior space 69 for receiving an air generator 72 (e.g., a fan). A plurality of cylindrical support posts 74 extend from the top of the upper housing 70, with each post 74 adapted to be secured to (e.g., by friction-fit) a separate cylindrical receiving post 76 provided in corresponding locations on the bottom plate 66. The motor 44 is mounted on top of the upper housing 70 between the upper housing 70 and the bottom plate 66, and between the posts 74. An opening 78 is provided in the bottom plate 66 to allow a motor gear 80 of the motor 44 to extend through into the interior of the gear and pump housing 62 to operatively engage a gear 142 of the pump system. Similarly, an opening 82 is provided in the upper housing 70 to allow a bottom shaft 84 of the motor 44 to extend through to operatively couple the fan 72 via a central bore 86 of the fan 72, to allow the motor 44 to rotate the fan 72 and its blades 88. An opening 90 is provided in the fan support base 68 through which external air can be directed in to the fan 72.

A bubble generating chamber 92 is defined by a dish housing 94 and the top wall 38. A gear piece 96 is positioned between the top plate 64 and the bottom wall 98 of the dish housing 94. Cylindrical posts 100 extend from openings in the bottom wall 98 of the dish housing 94. Each set of posts 74, 76 and 100 is connected together to define a continuous path through their hollow interiors from the interior space 69 of the fan housing 60 to the chamber 92, so that the air generated by the fan 72 inside the fan housing 60 is delivered via the posts 74, 76, and 100 to the chamber 92.

A bubble generator 102 is provided inside the chamber 92. The bubble generator 102 can have the shape of a cross or an "X", with four separate arms or wands extending from a center hub. The bubble generator 102 and its four wands are stationary and do not move. The bubble generator 102 includes a lower housing 104, an upper housing 106, a control gear 110, and four rotating applicators 108 housed between the lower and upper housings 104, 106. Each applicator 108 corresponds to each of the four wands. The control gear 110 is positioned inside the chamber 92 between the bottom wall 98 and the bottom of the lower housing 104. The lower housing 104 has a central hub space 105, and each arm 112 of the lower housing 104 defines a channel 115 that communicates with, and extends from, the hub space 105. Each arm 112 also has a generally circular toothed opening 114 and a gear opening 116. Thus, bubble solution that is delivered to the hub space 105 can flow along the channels 115 to each toothed opening 114. Each applicator 108 has a shaft 118 with a semi-circular section 120 (see FIG. 9) at one end of the shaft 118, and a gear 122 at the other end of the shaft 118. The applicator 108 is seated in the arm 112 in a manner such that the shaft 118 pivots about a slot 124, with the semi-circular section 120 adapted to rotate inside the toothed opening 114, and the gear 122 extending through the gear opening 116. The upper housing 106 covers the lower housing 104 and the applicators 108, and has four arms 126, each corresponding to an arm 112 of the lower housing 104. Each arm 126 also has a toothed opening 128 that corresponds to, and is aligned with a toothed opening 114. In addition, each set of aligned toothed openings 114, 128 is aligned with the opened upper end of a post 100 so that the air from the interior space 69 of the fan housing 60 can be directed at the openings 114, 128 to produce bubbles.

In this regard, the aligned toothed openings 114, 128 together function as a bubble-producing wand or ring, and are disposed horizontally with respect to a support surface (e.g., the ground). The opened upper end of each post 100 defines an air hole 101 that is positioned directly (vertically) below each set of aligned toothed openings 114, 128. Each air hole 101 has a diameter that is less than the diameter of the toothed openings 114, 128 so that bubble solution that flows through the toothed openings 114, 128 will not enter the air hole 101. Instead, any excess bubble solution will flow from the toothed opening 114 around each post 100, and be collected at the bottom wall 98 of the dish housing 94, as described in greater detail below.

The top plate 38 is secured to the top of the dish housing 94 to enclose the chamber 92. Each opening 40 in the top plate 38 is aligned with a corresponding set of toothed openings 114, 128 to allow the bubbles produced at the toothed openings 114, 128 to be emitted vertically upwardly.

The teeth of the control gear 110 are adapted to engage the teeth of each gear 122 from each applicator 108. The control gear 110 is mounted for rotation below the lower housing 104, and has a generally circular shape and is sized so that each gear 122 that extends through an opening 116 can engage the teeth of the control gear 110.

Figure 5:
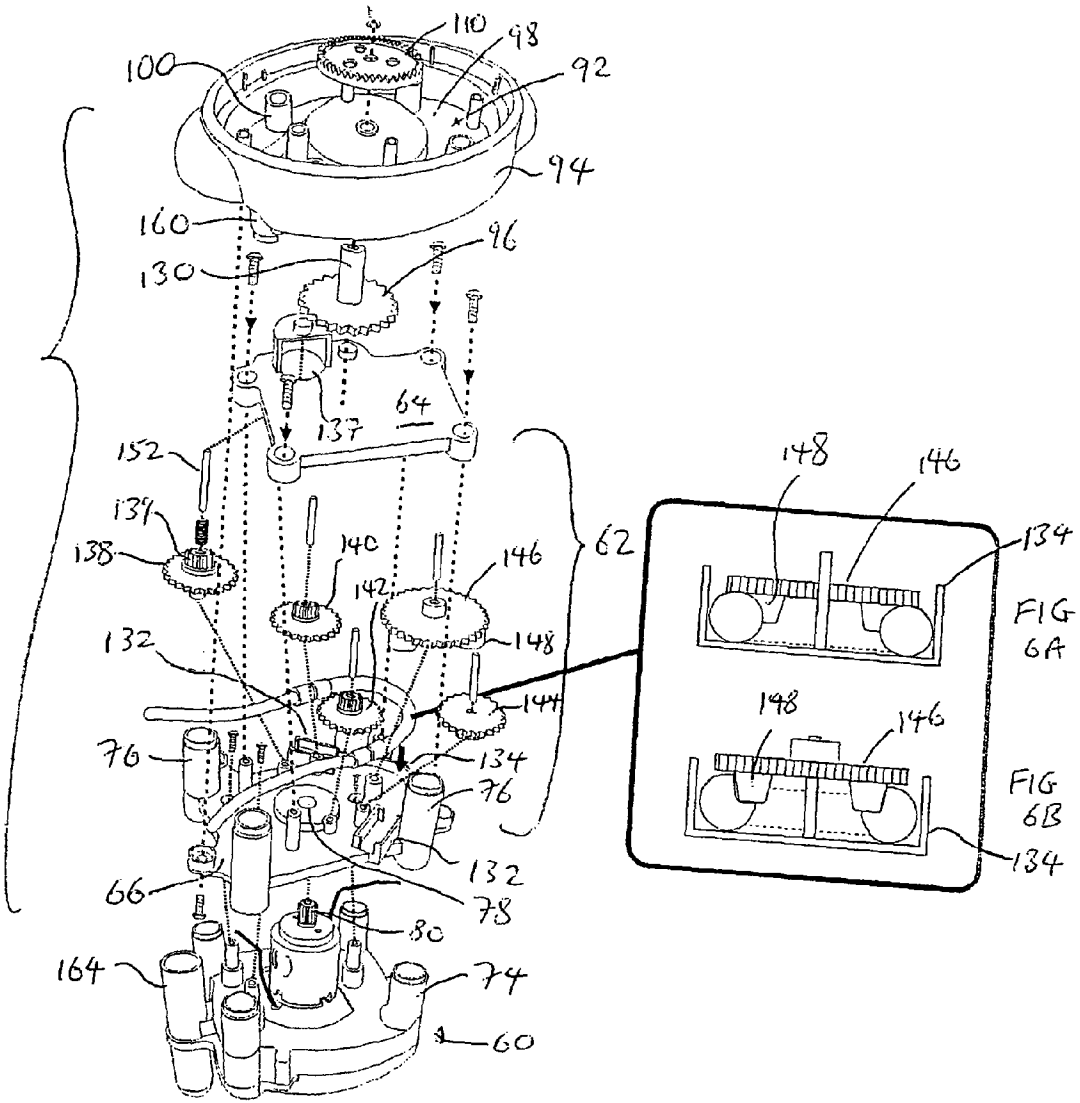
FIG. 5 is an exploded perspective view of the gear system and pump system of FIG. 3.

As best shown in FIG. 5, the motor gear 80 of the motor 44 extends through an opening in the plate 66 and is coupled to a gear 142 which is in turn coupled to the gear piece 96 (via other gears, as described below) for rotating the gear piece 96. The gear piece 96 in turn has a vertical shaft 130 that is coupled to the control gear 110 (via the bottom wall 98 of the dish housing 94). Therefore, activation of the motor 44 will cause the control gear 110 to rotate, which in turn causes the applicators 108 to rotate, and the semi-circular section 120 to rotate within the toothed openings 114, 128.

A pump system (described in greater detail below) is operatively coupled to the motor 44 via the motor gear 80, and is positioned inside the gear and pump housing 62 to pump the bubble solution from the solution container 28 via the tubing 32 to the hub space 105 inside the bubble generator 102. The tubing 32 extends from the solution container 28, through the pump system as described below, and then through the dish housing 94 to the center of the upper housing 106 where it terminates inside the space between the housings 104, 106. See FIG. 3.

As best shown in FIG. 5, the pump system includes the motor 44, the tubing 32, two sets of guide rails 132 and a guide wall 134 provided on the bottom plate 66, and a gear system that functions to draw bubble solution through the tubing 32. As the tubing 32 enters the gear and pump housing 62, it extends through one set of guide rails 132, then conforms to the guide wall 134, and then extends through the other set of guide rails 132 before extending to the dish housing 94.

The gear system includes the motor gear 80 that is rotatably coupled to the motor 44, a first gear 138, a second gear 140, a third gear 142, a fourth gear 144, a fifth gear 146, and two pressure rollers 148 that are secured to the bottom surface of the fifth gear 146. Each of these gears 138, 140, 142, 144, 146 is rotatably secured via shafts (e.g., 152) for rotation between the top plate 64 and the bottom plate 66, and are arranged so that their respective teeth engage the teeth of one or more of the other gears 138, 140, 142, 144, 146. As a result, when the motor 44 is turned on, its motor gear 80 engages the third gear 142, causing all the other gears 138, 140, 144, 146 to rotate synchronously. The upper gear of the first gear 138 extends through an opening 137 of top plate 64, and is coupled to the gear piece 96 to rotate the applicators 108.

The pressure rollers 148 are spaced apart along the outer periphery of the fifth gear 146. Each pressure roller 148 has a truncated cone configuration which has a largest diameter at a base section where the roller 148 is connected to the fifth gear 146, with the diameter decreasing to a smallest diameter at an end at its furthest distance from the fifth gear 146. The tubing 32 is received between the pressure rollers 148 and the guide wall 134 conforming against the curvature of the guide wall 134.

The assembly 20 operates in the following manner. When the switch 24 is turned on, the closure of the electrical circuit will cause the motor 44 to be actuated, thereby causing the motor 44 to rotate its motor gear 80 and causing the gears 138, 140, 142, 144, 146 to rotate. As the fifth gear 146 rotates, the rollers 148 will also rotate because they are carried by the fifth gear 146. As the rollers 148 rotate, they will apply selected pressure on different parts of the tubing 32 in the manner described below to draw bubble solution from the solution container 28, through the tubing 32, to the hub space 105. This is shown in the transition from FIG. 6A to FIG. 6B. At the same time, actuation of the motor 44 will rotate the shaft 84, thereby causing the fan 72 to cause air to be generated and delivered vertically upwardly through the posts 74, 76, 100 and through the toothed openings 114, 128.

Simultaneously, rotation of the gears 138, 140, 142, 144, 146 will cause the control gear 110 to rotate the applicators 108. As the applicators 108 rotate, each semi-circular section 120 rotates within its corresponding toothed opening 114, 128 to define convex and concave positions. In this regard, the semi-circular shape of the sections 120 define a concave position 121 and a convex position 123. The bubble solution delivered to the hub space 105 flows along the channels 115 to the toothed openings 114, 128, where the force of gravity causes the bubble solution to spill into each toothed opening 114, 128 along the edges of the toothed openings 114, 128. The openings 114, 128 have jagged edges which form teeth so that the bubble solution flows through these teeth to form a film of bubble solution. The bubble solution that spills into each toothed opening 114, 128 is contacted by the rotating semi-circular section 120. The semi-circular shape of the section 120 brings the contacted bubble solution from one side to the other wide, up to the convex position 123, and then down to the concave position 121 (like a dome), thereby forming a film of bubble solution. A stream of continuous bubbles (see FIG. 1) is produced from each opening 40 as air from the fan housing 60 and the posts 74, 76, 100 travels past the rotating semi-circular section 120 and impinges on the bubble solution film that has been created. The applicator 108 (and its semi-circular section 120) continues to rotate to form new bubble solution films, thereby allowing the creation of bubbles to be continuous.

To stop producing streams of bubbles, the user merely turns off the switch 24, thereby turning the motor 44 off, stopping the fan 72, the rotation of the gears and applicators 108, and the action of the pump system.

The bubble solution that flows through the toothed openings 114, 128 and do not contact the semi-circular section 120 will be collected at the bottom wall 98 of the dish housing 94. A cylindrical feedback post 160 extends from an opening 162 in the bottom wall 98, and the post 160 is coupled to another cylindrical feedback post 164 that is attached to the upper housing 70 of the fan housing 60. The bottom of the post 164 is secured to an opening 166 at the top wall 168 of the solution container 28 so that the excess bubble solution collected in the dish housing 94 can be flowed back into the solution container 28 via the posts 160 and 164. Thus, the feedback posts 160 and 164 function as a feedback channel for delivering excess bubble solution back into the solution container 28.

Thus, the present invention provides a novel and unique bubble generator 102 that eliminates the need for a space-consuming linkage system that is normally needed to form films of bubble solution, and which allow for the generation of a stream of bubbles that are emitted vertically upwardly. In particular, the orientation of the applicators 108 and the semi-circular sections 120 are facing upwards, which facilitates the generation of vertical streams of bubbles.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly, comprising:

a housing having a base that rests on a surface, the housing having a motor, an air generator coupled to the motor, and a bubble generator associated therewith;

a source of bubble solution positioned at the bottom of the base adjacent the surface; and a pump system provided inside the housing that draws bubble solution from the source to the bubble generator;

wherein the bubble generator includes a plurality of toothed openings each defining a channel through which air from the air generator is directed, and a plurality of rotating applicators each having a shaft, a curved section extending from one end of the shaft, and a gear at another end of the shaft that has teeth circumferentially around the shaft, with each of the gears operably coupled to the motor via a control gear that is positioned below the bubble generator, the control gear engaging the teeth of each of the gears of the applicators, and the control gear operably coupled to the motor such that actuation of the motor causes the control gear to rotate, wherein one of each of the curved sections is positioned inside one of each of the channels of the toothed openings and rotates inside each respective channel, with bubble solution that is delivered to the bubble generator flowing through the toothed openings; and wherein the air generator is positioned below the bubble generator, and the air from the air generator is delivered upwardly through the toothed openings.

2. The assembly of claim 1, wherein the rotation of the control gear causes each of the gears of each of the applicators to rotate their respective curved sections inside their respective channel of the toothed openings.

3. The assembly of claim 1, further including a gear system that is operably coupled to the motor and the control gear.

4. The assembly of claim 1, wherein the bubble generator includes a housing that defines a chamber for receiving the bubble solution, with the plurality of toothed openings provided in the housing, and through which solution received in the chamber may flow.

5. The assembly of claim 1, wherein the air generator has an air hole positioned directly vertically below the plurality of toothed openings.

6. The assembly of claim 1, wherein the plurality of toothed openings is oriented horizontally with respect to the ground.

7. The assembly of claim 1, wherein the bubble generator is configured with a plurality of wands, with each of the plurality of wands having one of the toothed openings, and having a flow channel which guides the flow of bubble solution to the toothed openings.

8. The assembly of claim 7, wherein the bubble generator includes a plurality of rotating applicators, each having a semi-circular section that rotates inside a separate toothed opening.

9. The assembly of claim 7, wherein the bubble generator includes a housing that defines a chamber for receiving the bubble solution, with the plurality of toothed openings provided in the housing, and through which solution received in the chamber may flow.

10. The assembly of claim 7, wherein the air generator has a plurality of air holes, each positioned directly vertically below one of the plurality of toothed openings.

11. The assembly of claim 7, wherein each of the plurality of toothed openings is oriented horizontally with respect to the ground.

12. The assembly of claim 1, further including a feedback channel coupled to the bubble generator for delivering excess bubble solution from the plurality of toothed openings back to the source.

13. The assembly of claim 5, wherein each air hole has a diameter that is less than the diameter of each toothed opening.

14. A bubble generating assembly, comprising:

a housing having a base that rests on a surface, the housing having a motor, an air generator coupled to the motor, and a bubble generator associated therewith;

a source of bubble solution positioned at the bottom of the base adjacent the surface; and a pump system provided inside the housing that draws bubble solution from the source to the bubble generator;

wherein the bubble generator includes a plurality of toothed openings each defining a channel through which air from the air generator is directed, and a plurality of applicators, one of each of the applicators positioned inside one of each of the openings and each of the applicators having a rotating applicator having a shaft, a curved section extending from one end of the shaft, and a gear at another end of the shaft that has teeth circumferentially around the shaft, with each of the gears operably coupled to the motor via a control gear that is positioned below the bubble generator, the control gear engaging the teeth of each of the gears of the applicators, and the control gear operably coupled to the motor such that actuation of the motor causes the control gear to rotate, wherein one of each of the curved section moves in and out of one of each of the respective channels of the toothed openings, with bubble solution that is delivered to the bubble generator flowing through the toothed openings; and wherein the air generator is positioned below the bubble generator, and the air from the air generator is delivered upwardly through the toothed openings.

15. The assembly of claim 14, wherein the rotation of the control gear causes each of the gears of each of the applicators to move their respective curved sections in and out of their respective channel of the toothed opening.

16. The assembly of claim 14, further including a gear system that is operably coupled to the motor and the control gear.

* * * * *